United States Patent [19]

Geppert

[11] 4,178,591

[45] Dec. 11, 1979

[54] CRANE OPERATING AID WITH OPERATOR INTERACTION

[75] Inventor: Steven Geppert, Bloomfield Hills, Mich.

[73] Assignee: Eaton Corporation, Cleveland, Ohio

[21] Appl. No.: 917,450

[22] Filed: Jun. 21, 1978

[51] Int. Cl.[2] ..... G08B 21/00

[52] U.S. Cl. ..... 340/685; 212/39 A; 212/39 R

[58] Field of Search ..... 340/685; 212/39 R, 39 A

[56] References Cited

U.S. PATENT DOCUMENTS

| | | | |
|---|---|---|---|
| 3,866,200 | 2/1975 | Parades et al. | 340/685 |
| 3,971,008 | 7/1976 | Nishizaki et al. | 340/685 |
| 4,052,602 | 10/1977 | Horn et al. | 340/685 |
| 4,057,792 | 11/1977 | Pietzsch et al. | 340/685 |
| 4,063,649 | 12/1977 | Hubbard et al. | 340/685 |
| 4,078,668 | 3/1978 | Hohmann | 340/685 |
| 4,133,032 | 1/1979 | Spurling | 340/685 |

*Primary Examiner*—Glen R. Swann, III

*Attorney, Agent, or Firm*—R. J. McCloskey; D. Wood; G. Lewis

[57] ABSTRACT

A crane operating aid comprises a load moment computer and a number of transducers which monitor crane parameters such as boom length, boom angle, and boom reaction forces. The computer then calculates the percentage of load capacity as a function of the crane manufacturer's published load rating tables. The computer is disposed near the crane operator to facilitate interaction between the two and actively solicits crane condition information from him through a prompting scheme which initially poses a series of status requests to the operator. The operator must supply appropriate responses to the status requests prior to operating the crane. The computer also can display any of the input parameters monitored by the transducers. A plurality of alarms of ordered urgency are provided which indicate various overlimit conditions. Both minimum and maximum operator controlled set points are provided. The series of prompting crane status requests can be repeated automatically such as with each start up of the crane or at the operator's option such as when a change of crane status occurs during operation. The crane operating aid is easily adapted to use with lattice or telescoping type cranes.

58 Claims, 14 Drawing Figures

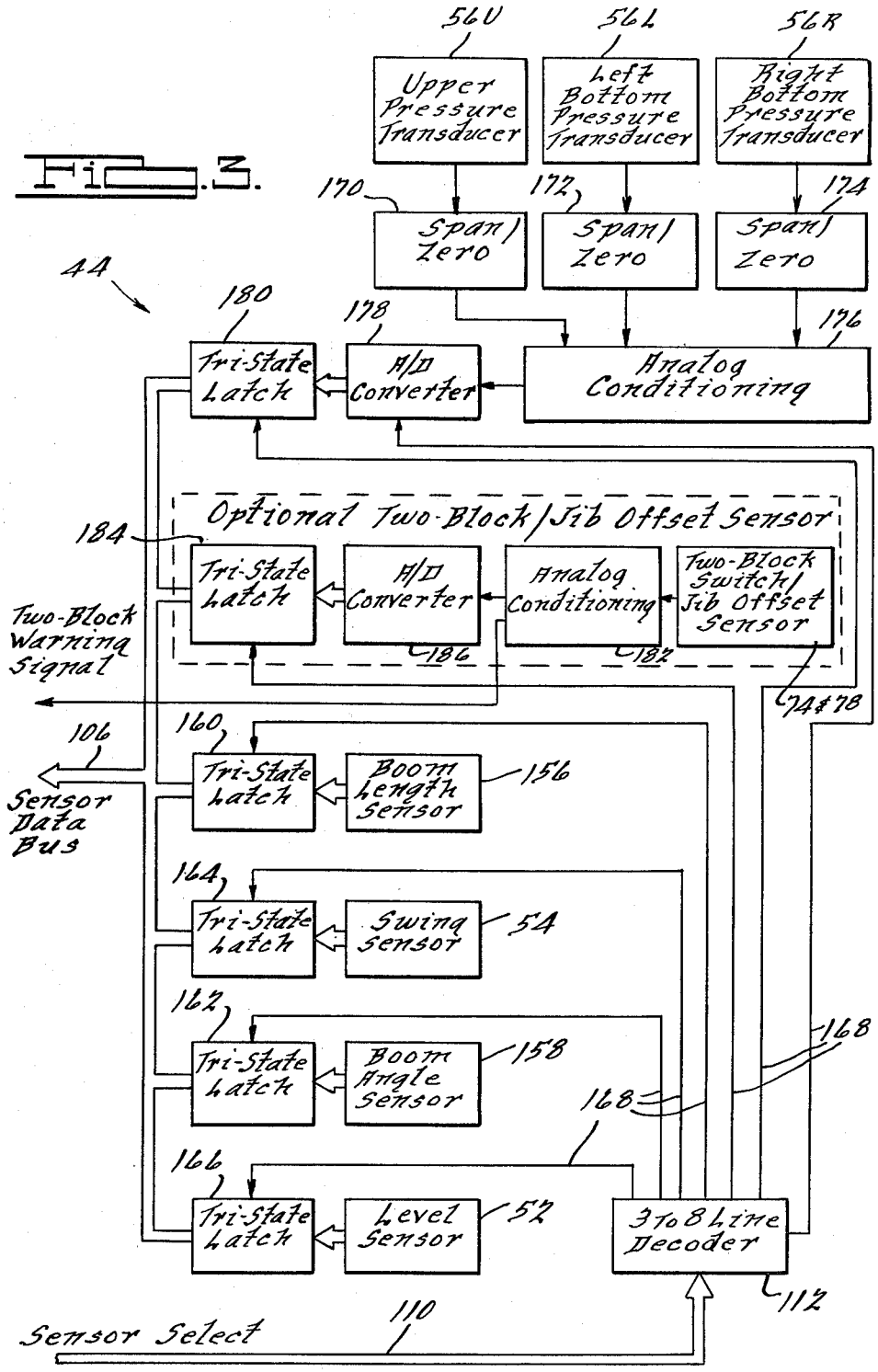
Fig. 3.
56U
Upper Pressure Transducer
56L
Left Bottom Pressure Transducer
56R
Right Bottom Pressure Transducer
170
Span/Zero
172
Span/Zero
174
Span/Zero
44
180
Tri-State Latch
178
A/D Converter
Analog Conditioning
176
Optional Two-Block/Jib Offset Sensor
184
Tri-State Latch
A/D Converter
Analog Conditioning
Two-Block Switch/Jib Offset Sensor
186
182
74&78
Two-Block Warning Signal
106
Sensor Data Bus
160
Tri-State Latch
Boom Length Sensor
156
164
Tri-State Latch
Swing Sensor
54
162
Tri-State Latch
Boom Angle Sensor
158
168
168
166
Tri-State Latch
Level Sensor
52
3 to 8 Line Decoder
112
Sensor Select
110

44
Power Up/ Reset Circuit
86

88
Clock Generator
Microprocessor
Ram Read/Write Memory
94
84
82
92
Buffer
98
Address Decoder
I/O Control
102
96
I/O Data
100
I/O Addresses
Prom Program Memory
Prom Custom Crane Memory
90A
90B 78
74
340

Two-Block Warning Signal
358
354
356
352
344
+15
246
360
362
364
348
350
346
366
342
182
A/D Converter (186)

CRANE OPERATING AID WITH OPERATOR INTERACTION

INTRODUCTION

This invention relates to methods and apparatus for aiding in the operation of a crane and specifically to such devices which provide means for communication between the operator and the crane operating aid.

BACKGROUND OF THE INVENTION

Devices for calculating and displaying the load supported by cranes, derricks, and the like, have long been used as operator aids in preventing unstable conditions or the overstressing of structural elements in the crane boom. This capability is particularly important in mobile cranes of the type having telescopingly extendable booms which can be slewed through the whole or part of a circle during normal operation. By comparing the load indication of an operating aid with the load rating tables supplied by the crane manufacturer for a specific crane and operating configuration, an operator can determine the relative stability of the crane. Typically, two methods of determining the load supported by a crane have been employed.

The first method involves the direct measurement of the actual weight of the load by devices such as tensiometers, strain gauges, and the like.

The second method involves the calculation of the total effective hook load, which is determined by first calculating the total turning moment of the boom and load about the boom pivot pin. By dividing the total turning moment by the horizontal radius of the load from the pivot pin, the total effective load can be calculated.

With both methods the actual load or total effective load can thus be determined and displayed to the operator who, upon referral to the load rating tables, can determine the amount of crane lifting capacity remaining at any given time.

A problem with prior schemes is that the operator, in order to take advantage of a load indicating operating aid, must continuously watch the load indication and refer to the rating tables supplied by the manufacturer. A disadvantage of this type of arrangement is that it distracts the operator's attention, which should be primarily focused upon the load and boom. Additionally, as the boom is extended and/or luffed, the geometrical configuration of the crane is changed, requiring the operator to refer to a different chart appropriate for that particular configuration. The probability of operator error is compounded by the fact that the published rating tables can be (and are often) confusing and subject to misinterpretation. If a fly or jib is in use, additional calculations must be made by the operator to determine his loading capacity.

Prior art devices such as those described in U.S. Pat. Nos. 3,913,690 and 4,063,649 to Hubbard et al., have eased some of the above described problems somewhat by providing "law generators" or hard wired electrical circuit equivalents to the load tables which must be plugged, one at a time, into the load moment computer for any given operating configuration. These circuits however, have the disadvantage of requiring removal and replacement each time the operator switches operating mode of the crane and/or adds a fly or jib.

Prior art operating aids as a whole, tend to detract from the operator's attention and introduce an inconvenience, which many operators overcome by simply ignoring or defeating the aid in deference to their own experience and judgment. As cranes become larger and more complex, however, this reliance upon operator judgment is becoming less and less desirable. Additionally, operating aids are called upon to supply more diverse types of information to the operator while permitting him to maintain his concentration on the load and boom. Another problem with the prior art devices arising from this increasing complexity is the prolonged set up and implementation time required. Existing units are typically extremely complex and may require several days to incorporate within a crane and fully calibrate. This complexity carries over into the operating arena wherein the operator must have a relatively high level of technical competence to fully utilize the aid provided him. Additionally, the commercially available prior art devices typically are extremely expensive.

BRIEF DESCRIPTION OF THE INVENTION

The present invention provides a crane operating aid which is extremely versatile, low in cost, requires a relatively short set up or implementation time and can be employed by a relatively unskilled operator. This is accomplished by an aid comprising a number of sensors incorporated within the crane and operative to generate signals representative of selected crane parameters such as luffing angle, boom length, boom reactive forces, and the like. Additionally, operator interface means are provided which facilitate two-way communication between the operating aid and the operator by sequentially presenting a series of prompting crane status requests to the operator and receiving his responses thereto. Finally, logic means are provided which receive the output signals from the sensors representative of each of the crane status parameters as well as the operator responses. The logic means then generates a crane condition signal, as a function of the output signals and operator responses, which can be sensed by the operator.

In a preferred embodiment of the invention, storage means are also provided which store the output signals from the sensors and which may also contain parametric information such as the rating tables supplied by the manufacturer. Any information that is required for calculating the crane's status which is not stored in the memory is solicited from the operator by the prompting crane status requests. As each request is posed, the operator provides a response thereto before the next status request in the sequence is posed. Thus, a series of prompting crane status requests or questions are posed by the operating aid to the operator who in turn supplies appropriate responses thereto. Typically, the type of information that would be requested of the operator would be the crane support condition, hoist rope specifications, fly condition, jib condition, and the like.

Other transducers that are employed in the preferred embodiment of the invention are level sensing transducers and slewing angle transducers. Optional transducers are provided depending upon the desired boom configuration such as anti two-block switches and fly jib offset transducers.

In the preferred embodiment of the invention the operator interface means is made of a control console deposed within the crane's cab or otherwise adjacent a designated operator position to facilitate both sensory and physical interaction between the operator aid and the operator. The control console contains printed indicia in the form of questions representing the series of status request which are posed to the operator and indicators adjacent each question and operative to designate which specific status request is being solicited by the operating aid.

According to another aspect of the preferred embodiment of the invention audible and/or visual warning means are provided to emit a number of differing signals under different operating conditions. Each of these signals is characterized by a different urgency scaling. For example, the audible warning means may emit a substantially continuous tone, a tone of varying frequency or one or more intermittent or beeping type tones of differing rates. The advantage of such a scheme is that the operator, upon sensing an alarm or signal, can immediately be apprised of its relative urgency. A continuous alarm might indicate an overload condition while a beeping or intermittent alarm having a relatively fast rate could indicate the nearing of a fixed percentage of an unstable condition and a relatively slow intermittent rate could indicate an overlimit or otherwise relatively unimportant condition.

According to another aspect of the invention, the operator interface means has means to receive the operator responses such as a keyboard. In the preferred embodiment, the keyboard is arranged in an array, a portion of which is operative to receive data input and another portion of which is operative to receive mode display selection input information. Additionally, input means are provided for operator determinable minimum and maximum set points.

According to another aspect of the invention, various other output indicator and display means are provided whereby both operator selected and other predetermined crane status information is presented to the operator via the operator interface means.

According to another aspect of the invention, percentage of rated load indicator means are provided which include percentage of rated overload indication means. This feature provides the operator with an actual load indication even in an overload condition.

According to another aspect of the invention, optional override means are provided to override driver control of the crane under certain predetermined operating conditions.

According to another aspect of the invention, memory means are provided which comprise first and second portions which are physically separable from each other. The first portion stores the general program structure while the second portion contains fixed parametric information about the crane such as dimensions, centers of gravity and the manufacturer's rating tables. The advantage of having two separable memory elements is that the first is common to all cranes of a given genre while the second is unique to a given model type. Therefore, implementation of a operating aid into a specific crane requires changing only one memory element.

Various other features and advantages of this invention will become apparent upon reading the following specification, which, along with the patent drawings, describes and discloses a preferred illustrative embodiment of the invention in detail.

The invention makes reference to the accompanying drawings.

BRIEF DESCRIPTION OF THE DRAWINGS

FIG. 3 is a partial block diagram of the operating aid of FIG. 2;

FIG. 13 is a schematic diagram of the analog conditioning circuit for the pressure transducers embodied in the present invention.

DETAILED DESCRIPTION OF THE SPECIFIC EMBODIMENT

Figure 1:
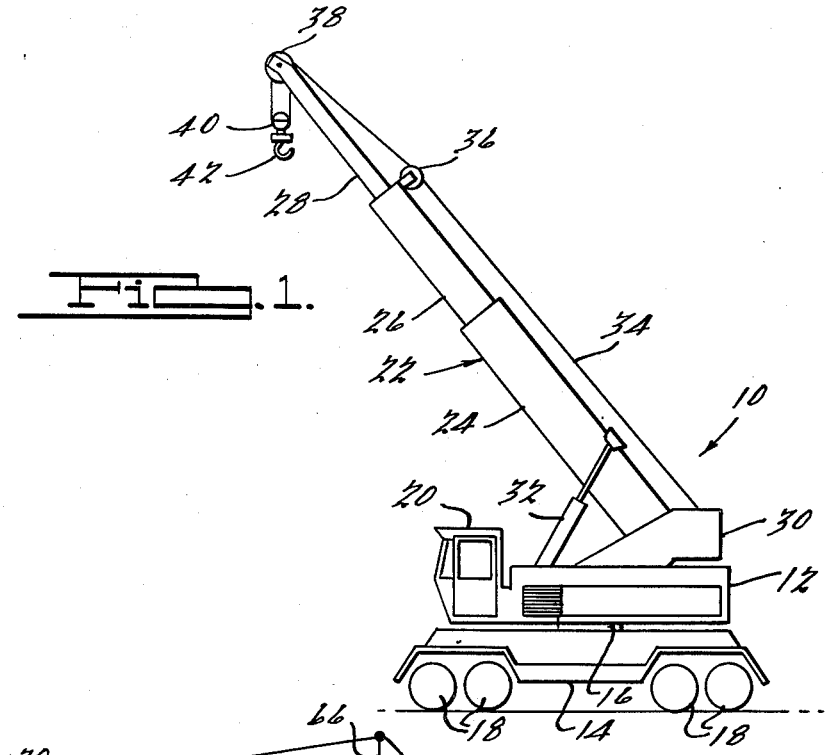
FIG. 1 is a side elevational view of a typical mobile crane within which the present invention is employed.

FIG. 1 illustrates a typical mobile crane 10 within which the present invention is employed. Crane 10 comprises a rotating part or upper 12 which is pivotably attached to a carrier or lower 14 through an intermediate slewing ring and gear 16. Lower 14 comprises wheels 18 as well as their related suspension, steering, and drive mechanism (not illustrated) which are controlled by the operator positioned in a cab 20. Cab 20 is illustrated as being an integral part of upper 12. In this type of configuration, an operator can operate the crane boom mechanism 22 associated with crane 10 as well as drive the vehicle from place to place. Other types of cranes are available having two cabs, one integral with the upper for use solely in controlling the crane boom mechanism, and one in the lower for driving the crane. Single cab cranes typically are designated as rough terrain mobile cranes while cranes employing two cabs are designated as carrier mount type cranes.

Upper 12 of the illustrated mobile crane 10 can be slewed or pivotably rotated a full 360° about an axis defined by slewing ring and gear 16. Lower 14 also includes outriggers (not illustrated) which are used to stabilize lower 14 when crane 10 is stationary by relieving the loading forces on tires 18. The utilization of outriggers is well known in the art and will not be elaborated upon here. Crane 10 thus has three support conditions; the first being when lower 14 is on outriggers, the most stable condition; the second being "on tires" where lower 14 is stationary but the outriggers are retracted; and third, the least stable condition being "pick and carry" wherein the outriggers are retracted and crane 10 is being driven while supporting a load.

Crane boom mechanism 22 comprises a hydraulic telescopingly extendable boom comprising a base section 24, midsection 26, and tip section 28. Although only one midsection is illustrated, it is contemplated that more than one could be employed. Boom mechanism 22 is typically double acting, requiring hydraulic pressure for retraction as well as deployment. The lowermost end of base section 24 is pivotably attached to a support member 30 which is integral with upper 12. One or more lift rams 32 support boom mechanism 22 through a range of luffing angles (the angle of inclination defined by the center line of boom 22 and horizontal). The rod end of each lift ram 32 is pivotably attached to base section 24 of boom mechanism 22 while the cylinder end of each lift ram 32 is pivotably attached to upper 12. An operator controlled hydraulic circuit (not shown) is provided whereby the operator, by deploying or retracting lift rams 32, can luff boom mechanism 22 to any desired angle. In the preferred embodiment of the invention two lift rams 32 are employed which laterally straddle base section 24 of boom mechanism 22.

A drum (not illustrated) selectively deploys a hoist rope 34 which passes over a support pulley 36 supported on the uppermost end of midsection 26 and continues to pass over a sheave pulley 38 pivotably affixed to the uppermost end of tip section 28 of boom mechanism 22. Hoist rope 34 then supportively passes through a floating bottom sheave block 40 and is fixedly connected with tip section 28. Hoist rope 34 could alternatively be fixedly connected to sheave block 40. Floating bottom sheave block 40 includes a load supporting hook 42. The operator, by controlling the hoist rope drum, can raise and lower loads affixed to hook 42.

Figure 2:
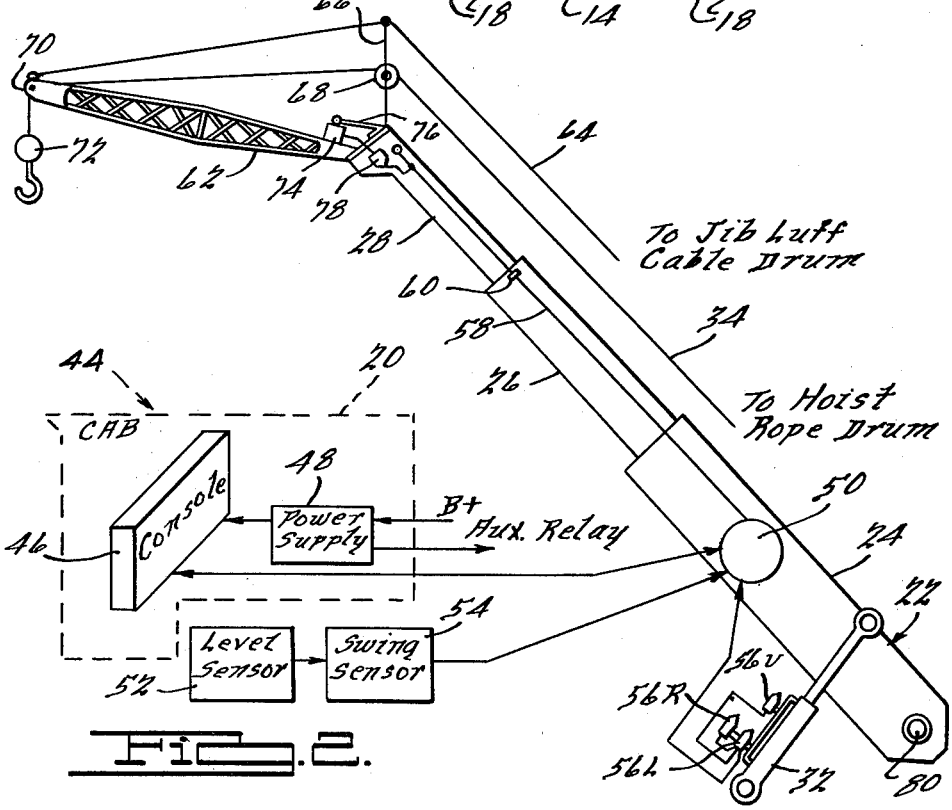
FIG. 2 illustrates the operating aid of the present invention in block diagram form, implemented in a telescoping crane, the crane boom being illustrated with an optional jib.

Referring to FIG. 2, a block diagram of a crane operating aid 44 embodying the present invention is illustrated. Operating aid 44 includes a console 46 located within cab 20 to provide intercommunication between aid 44 and the operator. Although console 46 is illustrated as being within cab 20 it is contemplated that it could be located anywhere adjacent a designated operator position. A power supply 48 energizes console 46 as well as various sensors which are electrically interconnected with console 46. Power supply 48 is electrically interconnected with B+ or the ignition system of crane 10. Power supply 48 also has an output which is electrically interconnected with an auxilliary relay (not illustrated) which is employed as an operator override to shut down certain hydraulic functions such as a "boom down" or "boom extend" should a certain predetermined set of conditions such as overload exist at any time. A combined boom angle/boom length/pressure conditioner box or transducer drum 50 is mounted to the base section 24 of boom mechanism 22 and is electrically connected with console 46 whereby power is transmitted from console 46 to box 50 and crane parametric information from the various transducers and sensors are transmitted from box 50 to console 46. A level sensor 52 and a swing sensor 54 are physically affixed to upper 12 and are electrically connected to box 50. Level sensor 52 provides a signal to operating aid 44 as a function of the relative horizontal disposition of crane 10. Swing sensor 54 provides slewing angle information, i.e., is the boom "over front", "over side", or "over rear", to operating aid 44. Three pressure transducers 56 are in fluid communication with the hydraulic fluid in lift rams 32 and transmit a signal to box 50 as a function of the pressure in lift rams 32. A boom angle transducer as well as a boom length transducer is disposed within box 50. The boom length transducer operates by paying out a cable 58 which is fixedly attached to the uppermost end of tip section 28 of boom mechanism 22 through supporting cable clips 60 affixed to the uppermost end of midsection(s) 26 of boom mechanism 22. The boom length transducer within box 50 measures the amount of cable 58 deployed as sections 26 and 28 of boom mechanism 22 are deployed and generates a signal proportional thereto.

FIG. 2 also illustrates an optional fly jib 62 pivotably attached to the uppermost end of tip section 28. Fly jib 62 is angularly offset from the center line of boom mechanism 22. This offset angle is determined by the amount of luff cable 64 deployed from a luff cable drum (not illustrated). Luff cable 64 passes over a cable support member 66 which is upstanding from and supported by the uppermost portion of tip section 28 of boom mechanism 22. Thus, the offset angle of fly jib 62 is controlled by the operator by deploying or retracting luff cable 64. Hoist rope 34 passes over a support pulley 68 pivotably attached to cable support member 66 and a sheave pulley 70 at the uppermost end of fly jib 62. Hoist rope 34 terminates in a weighted load supporting hook 72. A luff angle sensor 74 is affixed to fly jib 62 and has a mechanical position sensing link 76 interconnecting luff angle sensor 74 and tip section 28. An anti two-block switch 78 is affixed to the upper end of tip section 28. Both luff angle sensor 74 and anti two-block switch 78 are electrically interconnected with box 50 by cable 58. Anti two-block switch 78 operates as a position switch, sensing the proximity of load supporting hooks 42 and 72 to sheave pulleys 38 and 70 respectively. It is contemplated that either digital or analog sensors can be employed in operating aid 44. In the preferred embodiment however, the boom angle and boom length transducers as well as swing transducers 54 are digital devices while luff angle sensor 74 and pressure transducers 56 are analog devices. Box 50 also contains a circuit which provides analog conditioning of the pressure transducers signals. Thus, all of the sensor inputs of the crane are collected in the main transducer drum or box 50 for transmission to console 46.

One of the primary functions of aid 44 is to determine the effective load being supported by the load supporting hooks 42 or 72. As is well known in the art, this is accomplished by summing the load moments about boom pivot point 80 and dividing by the horizontal radius or distance between pivot point 80 and the load being supported by hooks 42 or 72. The aid 44, by calculating the effective weight support by the hook 42 or 72, can compare that figure with the maximum load permitted at that particular crane configuration and virtually instantaneously apprise the operator of the status of the crane.

In the embodiment of crane boom mechanism 22 illustrated in FIG. 2, two parallel lift rams 32 are employed which straddle base section 24. The rod side of rams 32 are commonly interconnected with transducer **56*u* while the cylinder sides of lift rams 32 each have their own transducers 56*r* (right) and 56*l* (left). The output signals of transducers 56*l* and 56*r* are averaged and the difference between the average and the output of transducer 56u, adjusted for the difference in pressure area, is transmitted to console 46**.

Fly jib 62 is illustrated as having the capability of being luffed by the operator. However, it is contemplated that luff cable 64 could alternatively be affixed to tip section 28 rather than to the jib luff cable drum in which situation the offset angle between the fly jib 62 and the boom mechanism 22 would be altered only by lowering boom mechanism 22 and manually resetting fly jib 62. Additionally, in some alternative embodiments, tip section 28 of boom mechanism 22 is manually operated rather than hydraulically whereby it must be deployed while boom mechanism 22 is in substantially horizontal position.

Figure 4:
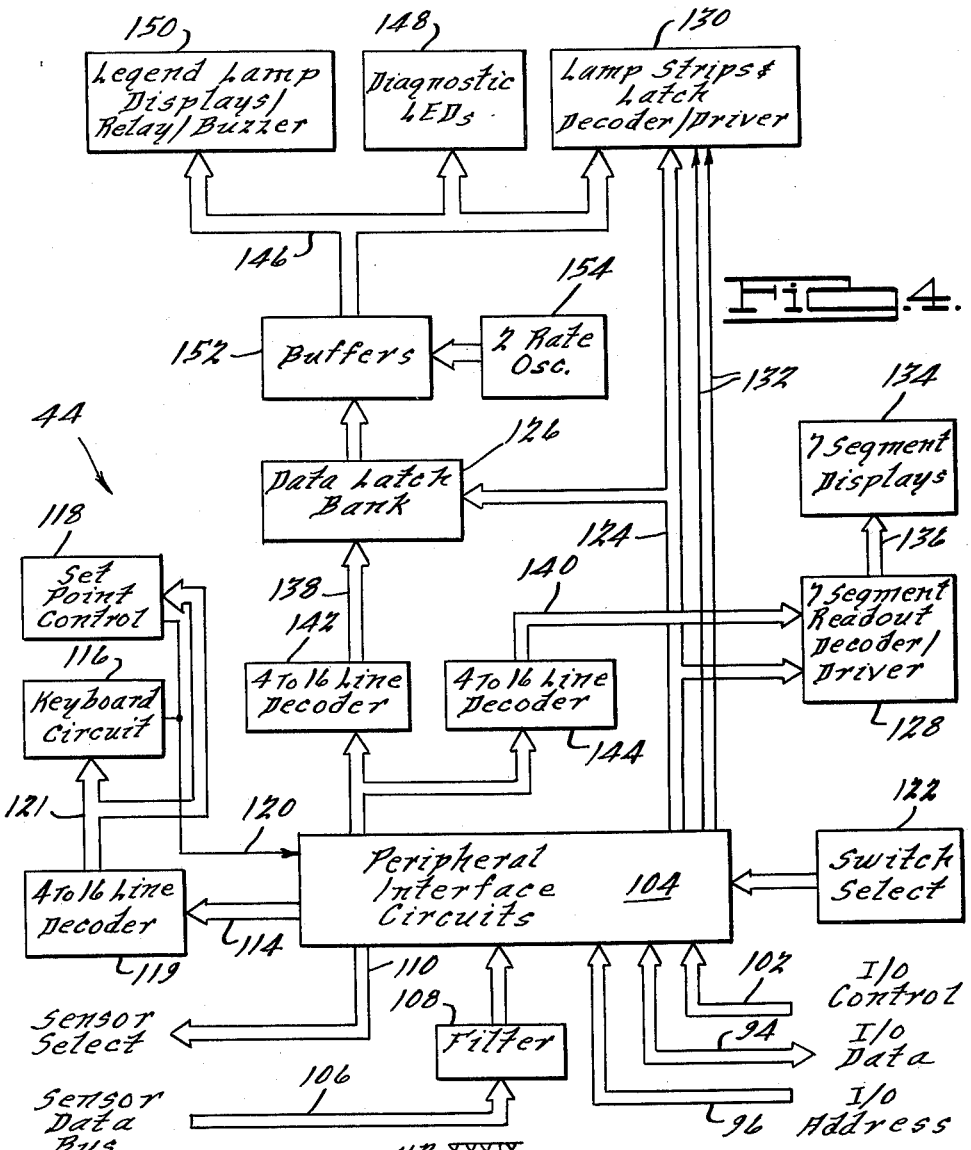
FIG. 4 is another partial block diagram of the operating aid of FIG. 2.
Figure 5:
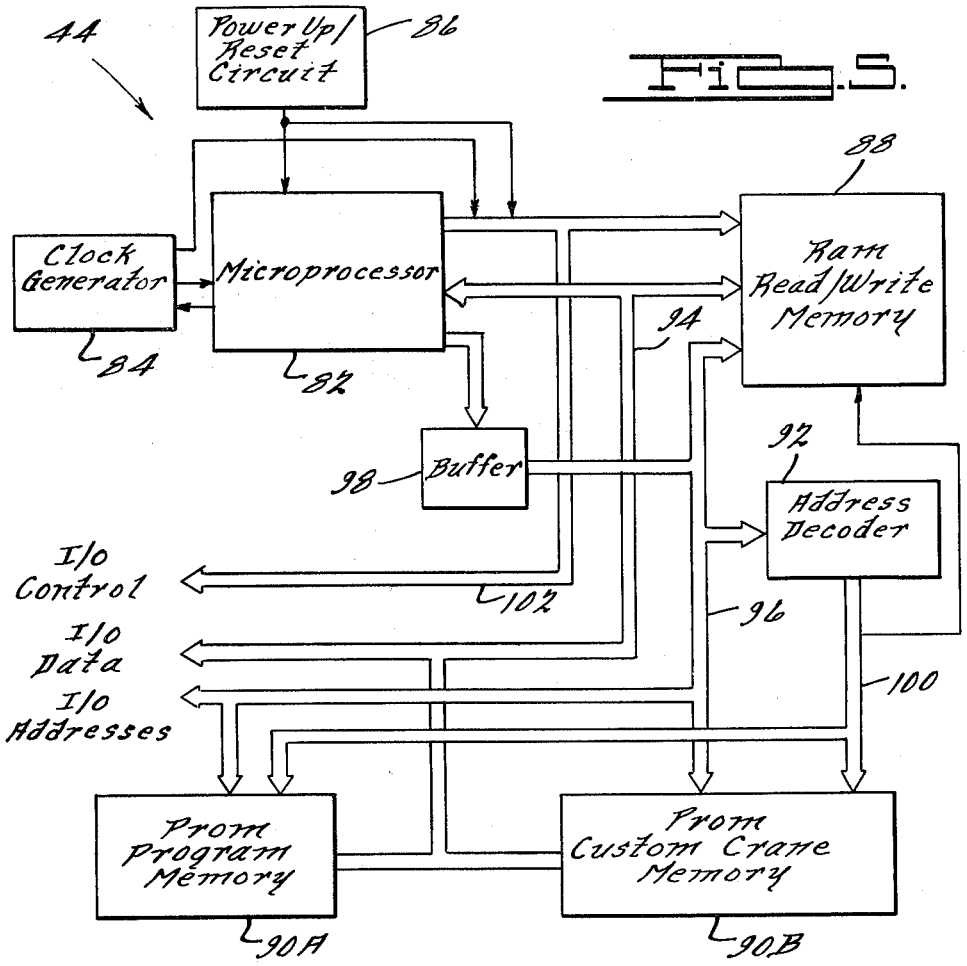
FIG. 5 is a partial block diagram, which along with the partial block diagrams of FIGS. 3 and 4 constitute the operating aid of FIG. 2.

Referring to FIGS. 3, 4, and 5, a block diagram of crane operating aid 44 is collectively illustrated. FIG. 5 illustrates the computer and memory portion of operating aid 44. FIG. 3 generally illustrates the transducers and sensors along with their interface with the rest of the circuit while FIG. 4 generally illustrates the operator oriented input/output (I/O) portion along with their interfacing circuitry of crane operating aid 44.

The computing portion of crane operating aid 44 comprises a type MOS TECHNOLOGY 6502 microprocessor 82 which is interconnected with a type IM 6561 read/write random access memory (RAM) 88 as well as a type SN 745472N programmable read only memory (PROM) by an I/O data bus 94 and an address bus 96. A signal amplifying type SN 7417 buffer 98 is connected in-line with address bus 96 between microprocessor 82 and RAM and PROM memories 88 and 90 respectively. PROM memory 90 is divided into two physically distinct and separated portions 90A and 90B. PROM memory portion 90A is reserved for program data which is commonly applied to all cranes of the type within which operating aid 44 is implemented while PROM memory portion 90B is custom and reserved for data which is uniquely characteristic or required by the specific model crane in which operating aid 44 is implemented. Because the RAM and PROM memories 88 and 90 respectively, consist of a relatively large number of individual chips or modules all of which are connected to address bus 96, a type SN 74L154 address decoder 92 is provided to receive an input from address bus 96, demultiplex the coded address signal and generate an enable signal for the identified RAM or PROM memory element 88 or 90 respectively. Enable lines 100 interconnect address decoder 92 and each of the RAM and PROM memory elements 88 and 90 respectively. An I/O control bus 102 electrically interconnects microprocessor 82 and RAM memory 88. A 500 KHz square wave timing signal is provided microprocessor 82 and I/O control bus 102 by a clock generator 84 which, in turn, receives timing signals from microprocessor 82. A power up/reset circuit 86 electrically feeds microprocessor 82 and control bus 102 for initialization of the microprocessor 82. Power up/reset circuit 86 also provides protection against transient low voltage pulses, causing reinitialization of the processor in such a case.

Referring to FIG. 4 control, data, and address buses 102, 94, and 96 respectively, are electrically connected to one or more peripheral interface adapters (PIA) or circuits 104 of the type manufactured by Motorola, type 6820. PIA 104 receives sensor data via a sensor data bus 106 which passes through an intermediate high frequency and hash filter 108. Output sensor select lines 110 interconnect PIA 104 and a type CD 4515 three to eight line decoder 112. Key test code lines 114 run from PIA 104 to a four to sixteen line decoder 119 and key test lines 121 run from decoder 119 to a keyboard decoder circuit 116 and a set point control circuit 118. Key and toggle sense lines 120 in turn pass from keyboard decoder circuit 116 and a set point control circuit 118 to PIA 104. The key test code transmitted over lines 114 interrogates each key in keyboard decoder circuit 116 and switch in set point control circuit 118 periodically to determine which, if any, has been actuated. A switch select circuit 122 includes a dual-in-line programmable (DIP) switch which serves two functions. During normal operation, the setting of the DIP switch in switch select circuit 122 determines what percent loading capacity will fire the auxilliary relay. Alternatively, switch select circuit 122 can be set to a predetermined diagnostic code for the display of raw input data or other critical signals within the crane software. A diagnostic display of light emitting diodes (LEDS) is provided within console 46 for this function. However, the display is for diagnostics only and is not normally within view of the crane operator.

An output data bus 124 interconnects PIA 104 with a bank 126 of type CD 4042 data latches, nine type 4511 seven segment readout decoder/drivers 128 and a lampstrips and latch decoder/driver circuit 130. PIA 104 and lampstrip and latch decoder/driver circuit 130 are also interconnected by two strip select lines 132. Each of the nine seven segment readout decoder/drivers 128 have an associated type 3015F BM15 seven segment display 134 interconnected with its associated driver 128 by segment driver lines 136. Data strobe lines 138 and 140 carry a strobe code for selecting specified output devices from PIA 104 to data latch bank 126 and seven segment readout decoder/driver 128 respectively through intermediate type CD 4515 four to sixteen line decoders 142 and 144 respectively. Output select lines 146 interconnect data latch bank 126 and lampstrips and latch decoder/driver 130, diagnostic lights 148 located within console 46 and various legend lamps displays, relays and buzzers 150, through an intermediate type ULN 2003 current amplifying buffers 152. The lampstrips and latch decoder/driver 130, legend lamps displays, relays, and buzzers 150, seven segment displays 134, set point control 118 and keyboard decoder circuit 116 are all physically mounted on console 146 within the cab 20 or otherwise near a designated operator position. Legend lamps, displays, relays, and buzzers 150, diagnostic LED 148 and lampstrips and latch decoder/driver 130 are all commonly connected to output data bus 124 through buffers 152 and latch bank 126.

A two rate oscillator 154 electrically drives the buffer 152 associated with the buzzer in the legend lamp, display, relay, and buzzer circuit 150. Oscillator 154 causes buzzer 150 to be pulsed two times per second whenever an operator establish set point is exceeded and four times per second whenever the load supported by the crane is off of the manufacturer's published load rating tables or when the load is between 85% and 100% of the rated load capacity designated on the tables. When the load exceeds a 100% of rated capacity, the buzzer sounds continuously.

Referring to FIG. 3, a boom length sensor 156 and a boom angle sensor 158 as well as swing sensor 54 and level sensor 52 are connected to sensor data bus 106 through type MM 80C97 tri-state latches 160, 162, 164, and 166 respectively. Boom length sensor 156, swing sensor 54 and boom angle sensor 158 are eight bit absolute encoding digital sensors such as manufactured by Baldwin Model 5V80, 5V200 and 5V680. Level sensor 52 comprises four mercury switches arranged in a quadrant configuration on the outriggers of crane 10. Transducer data select lines 168 interconnect the output of three to eight decoder 112 and each tri-state latch 160, 162, 164, and 166.

Pressure transducers 56*u*, 56*l*, and 56*r* each have a span/zero circuit 170, 172, and 174 respectively which interconnect pressure transducers 56 with an analog conditioning and pressure to force scaling circuit 176. The output of analog conditioning circuit 176 is an analog signal proportional to the average force differential across lift rams 32. This signal is fed into an analog to digital (A/D) converter 178 which, in turn, is fed to sensor data bus 106 through another tri-state latch 180. Transducer data select lines 168 interconnect three to eight line decoder 112 and tri-state latch 180 as well as three to eight line decoder 112 to A/D converter 178. One data select line 168 which is connected to A/D converter 178 serves to carry an A/D synchronizing trigger pulse.

An optional two-block/jib offset sensor is provided comprising the parallel combination of luff angle offset sensor 74 and anti two-block switch 78, the output of which is fed into an analog conditioning circuit 182 which amplifies and scales the output of two-block-switch 78 and jib offset sensor 74. If during operation, a two-block warning signal is generated at the output of analog conditioning circuit 182, that signal is fed directly to an operator warning device (not illustrated). Additionally, the output of analog conditioning circuit 182 is fed to a tri-state latch 184 through an A/D converter 186. One of the transducer data select lines 168 from three to eight line 112 is fed into tri-state latch 184. All transducers and sensors therefore are commonly fed to sensor data bus 106 through tri-state latches 180, 184, 160, 164, 162, and 166. Crane operator aid 44 therefore can receive data from any one of the transducers or sensors by generating an appropriate sensor select code on output select lines 110. Tri-state latch 180 is of the type MM 80C97 manufactured by National. A/D converters 170 and 178 are of the type 8700 CN manufactured by Teledyne. The specific integrated circuits enumerated herein are intended to be for illustration purposes only and it is contemplated that numerous other discreet and integrated devices could be substituted by one skilled in the art. Additionally, the actual software routines which would be employed with the system disclosed herein would be evident to one skilled in the art in light of this specification and a set of design parameters or a specific crane and desired operating features.

Figure 6:
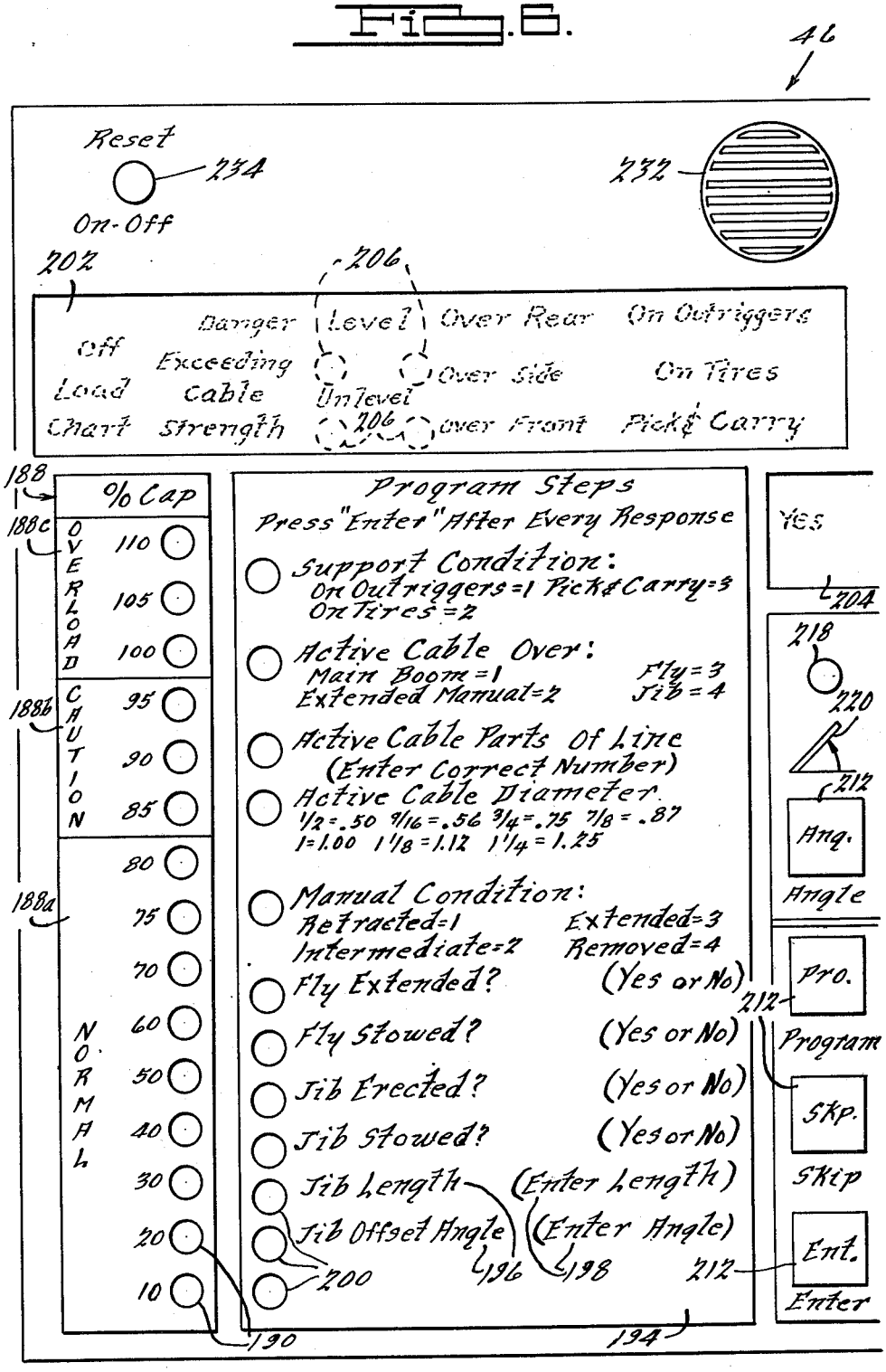
FIG. 6 is a plan view of the left half of the operator console of FIG. 2.
Figure 7:
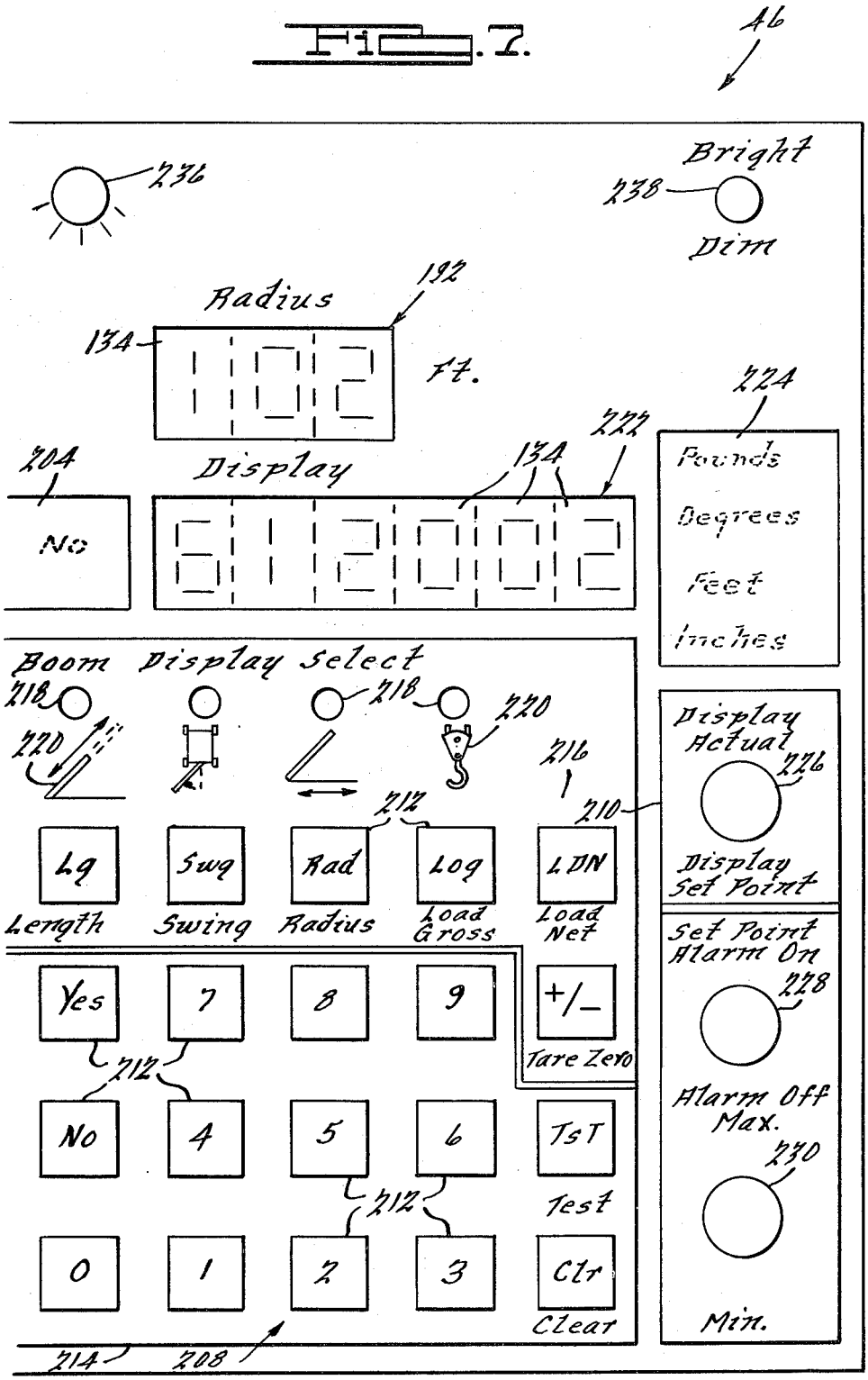
FIG. 7 is a plan view of the right half of the console of FIG. 2.

Referring to FIGS. 6 and 7, crane operating aid 44 interfaces with the crane operator through control console 46. All of the switches, lamps, legends displays, and the like necessary for intercommunication between the operator and operating aid 44 are located on console 46 to facilitate operating ease. Additionally, with the exception of transducers 56*u*, 56*l*, and 56*r*, sensors 74, 78, 156, 54, 158, and 52, span/zero circuits 170, 172, and 174, and analog conditioning circuits 176 and 182, all the logic and switching circuits of operating aid 44 illustrated in FIGS. 3, 4, and 5 are housed within console 46. All control and indicating devices located on console 46 are segregated into distinct function blocks some of which are subject to and others of which are independent of direct operator control. One function block that is independent of operator control is the percentage of rated load indicator 188 which comprises a vertical string of 15 incandescent lights or lamps 190 which are sequentially labelled from 10% to 110% of rated load. Only one of lights 190 is "on" at a given time thereby giving the operator an indication of the percent of rated load being supported by the crane at that particular instant. As the percentage load supported by the crane increases or decreases, the light 190 which indicates the proper percent of load at the present configuration will be on. The percent of load indicator 188 is subdivided into three parts 188A, 188B, and 188C. Part 188A is colored green and contains the lights 190 ranging from 10% to 80% of rated load, part 188B is colored yellow and contains lights 190 with the range from 85% to 95% of rated load, and part 188C is colored red and contains the range of 100% to 110% of rated load. By merely glancing at percentage of load indicator 188, the operator can quickly and accurately determine the percentage of the actual load being supported by the crane to that load specified by the crane manufacturer as being maximum permissible for that particular given crane configuration. The capability of reading percent capacity is provided to give the operator an accurate reading of the crane status even in the overload condition.

The other function block provided which is independent of operator control is a radius readout 192, comprising three seven segment displays 134 which continuously indicate to the operator the horizontal distance from boom pivot point 80 to the load suspended on hoist rope 34.

A prompting function block 194 is provided on console 46 containing indicia representing a series of prompting status request 196 along with a catalog of acceptable operator responses 198. For example, the first of the series of status requests pertains to the crane support condition. The three possible support conditions being; (1) on outriggers; (2) on tires or; (3) pick and carry, the operator must respond to that particular request by providing console 46 with the code number representative to the support condition of the crane at that particular time. Adjacent each prompting status request indicia 196 is an indicator such as an incandescent bulb 200. Operating aid 44 indicates to the operator which input information it desires by serially energizing each of the indicator lamps 200 while receiving the operator responses thereto. Questions not pertinent to a given crane are automatically skipped.

Prompting function block 914 cycles through the series of prompting status requests in response to an operator initiative such as start-up of the crane or operator intervention during normal operation. The latter normally occurs when a change of crane status has taken place such as the addition of a fly jib. It is contemplated, however, that "operator initiative" also includes activation of means which will periodically automatically recycle through the series of prompting status requests.

The entire surface of console 46 is a single sheet of photo etched translucent mylar or the like. The legends and indicia associated with percent of load indicator 188 and prompting function block 194 are first surface photo etched on the mylar, i.e., are printing on the surface closest the operator and are thus, always visible to him.

Two crane status indicator blocks 202 and 204 are provided on console 46 with second surface indicia which is only visible in the presence of back lighting. Incandescent bulbs (not shown) are provided behind each second surface indicia in blocks 202 and 204 to selectively display information to the operator which is currently significant or pertinent while not distracting him with the display of irrelevant indications. For example, the indicia in block 202 representative of the operator's most recent response to a given status respect would be displayed as a confirmation device. When the support condition status request is made and the crane was "on outriggers" at the time of the last status request and operator response, this fact would be demonstrated to the operator. Additionally, information such as "off load chart", "exceeding cable strength", and "level" are illuminated when appropriate to apprise the operator of those particular conditions. The level indication is transmitted to the operator by means of "level" and "unlevel" indicia as well as four lamps 206 arranged within block 202 in a quadrant equivalent to the crane to indicate which outrigger(s) is high or low with respect to the others. Crane status indicator block 204 contains second surface indicia "yes" and "no" which have back lighting and are selectively made visible to the operator when appropriate during the posing of the prompting status requests.

Two operator input blocks 208 and 210 are provided in console 46 to receive operator responses to the prompting status requests as well as operator initiated input. Operator input block 208 comprises an input portion 214 and a mode display select portion 216. Data input portion 214 comprises input keys 212 for digits zero through nine inclusion as well as "yes" and "no" response keys. Additionally, input data portion 214 also comprises "test", "clear", "program", "skip", and "enter" function keys. Mode display select portion 216 provides for operator selected display of boom angle, length, swing, radius, gross load, net load, and tare zero. Tare zero is defined as the difference between gross load and net load. Mode display select portion 216 also has a set of mode lamps 218 and internationally recognizable characters 200 associated with each lamp to identify the function the specific lamp 218 is designating.

A general purpose readout 222 comprising six seven segment displays 134 is provided on console 46. Readout 222 can be used to display any of the six functions included in mode display select portion 216 as well as a confirmation display of the operator response to prompting requests. A unit display block 224 is provided immediately adjacent the right handmost seven segment display 134 of general purpose readout 222 and includes indicia representing the units appropriate to the digital readout of display 222. The indicia of unit display block 224 are second surface photo etched on the mylar sheet with illuminating lamps therebehind so that only the appropriate indicia is visible at any given time. Although illustrated in English units, other systems such as metric could be substituted.

Operator input block 210 provides a set point function and comprises three manually operated toggle switches 226. 228, and 230. A manually entered set point is displayed on general prupose readout 222 when switch 226 has been shifted from its normal "display actual" position to the "display set point" position. A minimum or a maximum set point will be displayed depending upon the setting of toggle switch 230. Toggle switch 228 arms an audible alarm such as a buzzer 232 which, in the block diagram of FIG. 4 would be found in legend/lamp/display/relay/buzzer block 150. A visual alarm such as an attention attracting light can also be added. A set point is established merely by turning toggle switch 226 to "display set point", keying in the numerical set point desired on the data input portion 214 of input block 208 and hitting enter switch 212.

An on-off/reset switch 234 is provided as a manually redundant reset feature for the power up/reset circuit 86 of FIG. 5. A console illuminating bulb 236 and a bright/dim console illuminating function switch 238 are provided to accommodate varying ambient lighting conditions.

Figure 8:
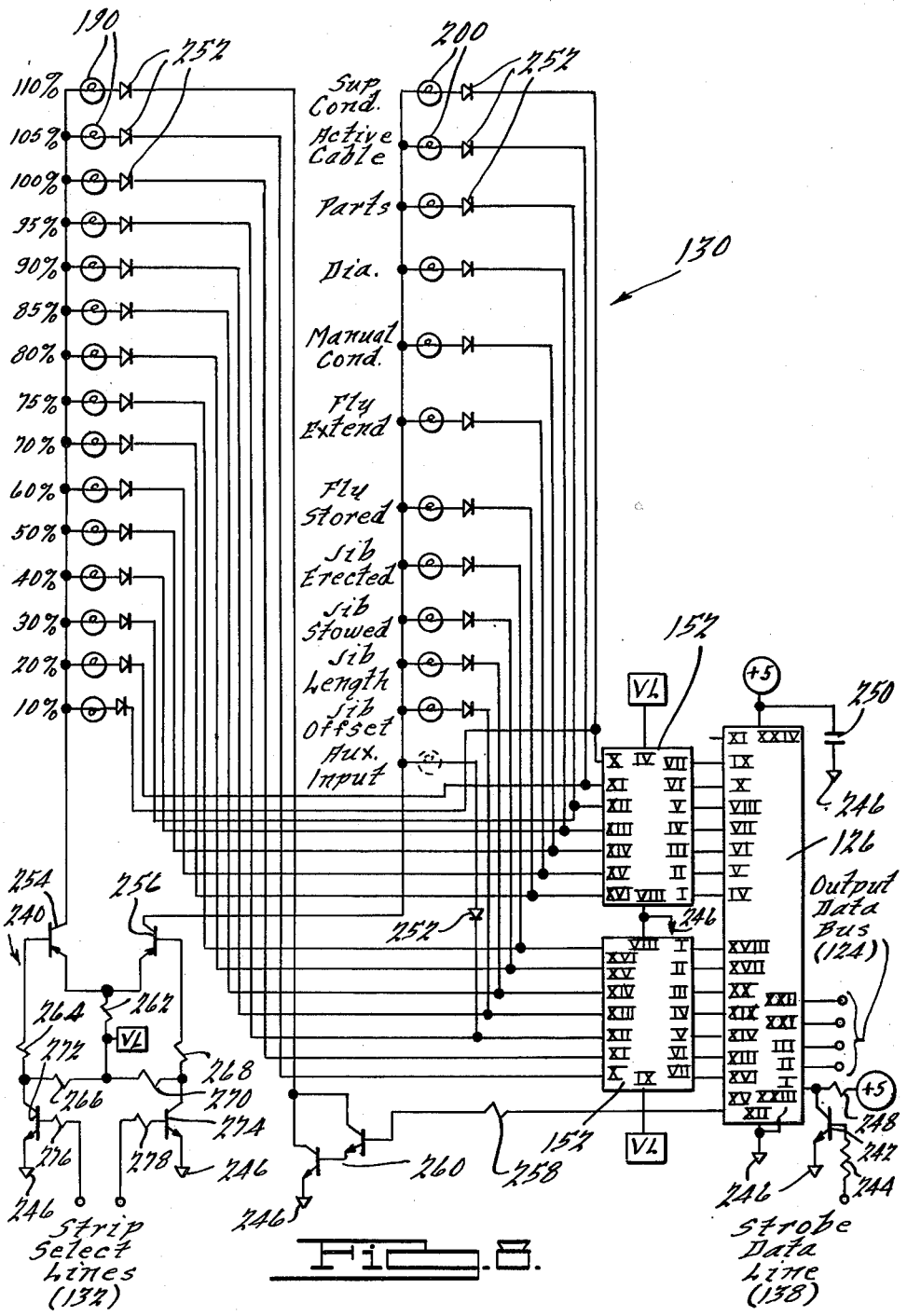
FIG. 8 is a schematic diagram of the lampstrips and latch decoder/driver embodied in the present invention.

Referring to FIG. 8, a schematic diagram of light strings 190 and 200 along with a strip select circuit 240 are illustrated. The lines of output data bus 124 are connected to input terminals II, III, XXI, and XXII of a type 4514 CP latch 126. Strobe data line 138 is connected to the base of a type 2N5172 transistor 242 through a 33 K Ohm current limiting resistor 244. To eliminate repetition, unless stated differently, all resistance values are in Ohms and capacitive values are microfarads. The emitter of transistor 242 is connected to a common tie point 246. The collector of transistor 242 is connected to terminal I of latch 126. Terminal I of latch 126 is also connected to a +5 VDC highly regulated voltage supply through a 4.7 K current limiting resistor 248. Strobe line 138 is pulsed approximately three times per second causing the current code on data bus 124 to be latched and ultimately used to select a light 190 or 200 to be illuminated. Output terminals XVI, XIII, XIV, XIX, XX, XVII, and XVIII of latch 126 are connected to input terminals VII, VI, V, IV, III, II, and I of type ULN 2003A buffer 152 respectively. Likewise, input terminals I, II, III, IV, V, VI, VII of a second buffer 152 are electrically connected to output terminals IV, V, VI, VII, VIII, X, and IX respectively of latch 126. Terminals VIII of both buffers 152 are electrically connected to tie point 246 while terminals IX of both buffers 152 are electrically connected to a relatively unregulated lamp voltage supply ($V_L$). Output terminals XII and XXIII of latch 126 are connected to tie point 246. Terminal XXIV of latch 126 is connected to the +5VDC power supply and to tie point 246 through a 0.01 filter capacitator 250.

Output terminals X, XI, XII, XIII, XIV, XV, XVI of both buffers 152 are each electrically connected to a light 190 and/or a light 200 through a diode 252. The other side of lights 190 are commonly connected to the collector of a type 2N4402 transistor 254 in strip select circuit 240. The other side of lights 200 are commonly connected to the collector of a second type 2N4402 transistor 256 in strip select circuit 240. As a design convenience, a single discreet buffer is in the form of a series 4.7 K resistor 258 and a two transistor (types 2N5172 and 2N3414) Darlington arrangement 260.

The emitters of transistors 254 and 256 are commonly connected to the lamp voltage supply through a 6.8 current surge limiting resistor 262. The base of transistor 254 is connected to lamp voltage supply through a series combination of a 1 K resistor 264 and 33 K resistor 266. The base of transistor 256 is likewise connected to lamp voltage supply through a series combination of a 1 K resistor 268 and a 33 K resistor 270. The tie point between resistors 264 and 266 is electrically connected to the collector of a type 2N5172 transistor 272 and the tie point between resistors 268 and 270 is electrically connected to the collector of another type 2N5172 transistor 274. The emitters of transistors 272 and 274 are electrically connected to tie point 246. The two strip select lines 132 are connected to the bases of transistors 272 and 274 through a 4.7 K resistors 276 and 278 respectively.

In normal operation one of the strip select lines 132 is high and the other one is a low. The only instance when that is not the case is when a set point is being established so as to prevent the operator from drawing any erroneous conclusions from percent of load or prompting status request indications. Light strings 190 and 200 are arranged so that only one can be at at a given time. Again, this is to prevent the operator from developing any false sense of security and to direct his attention to the appropriate operation of the operating aid 44. If, for example, the strip select lines 132 associated with transistor 272 goes low, transistor 274 will conduct whereby transistor 254 will be turned off and transistor 256 will conduct. Accordingly, only indicators 200 are connected to the lamp voltage supply and the one whose code is present on output data bus 124 will light.

Figure 9:
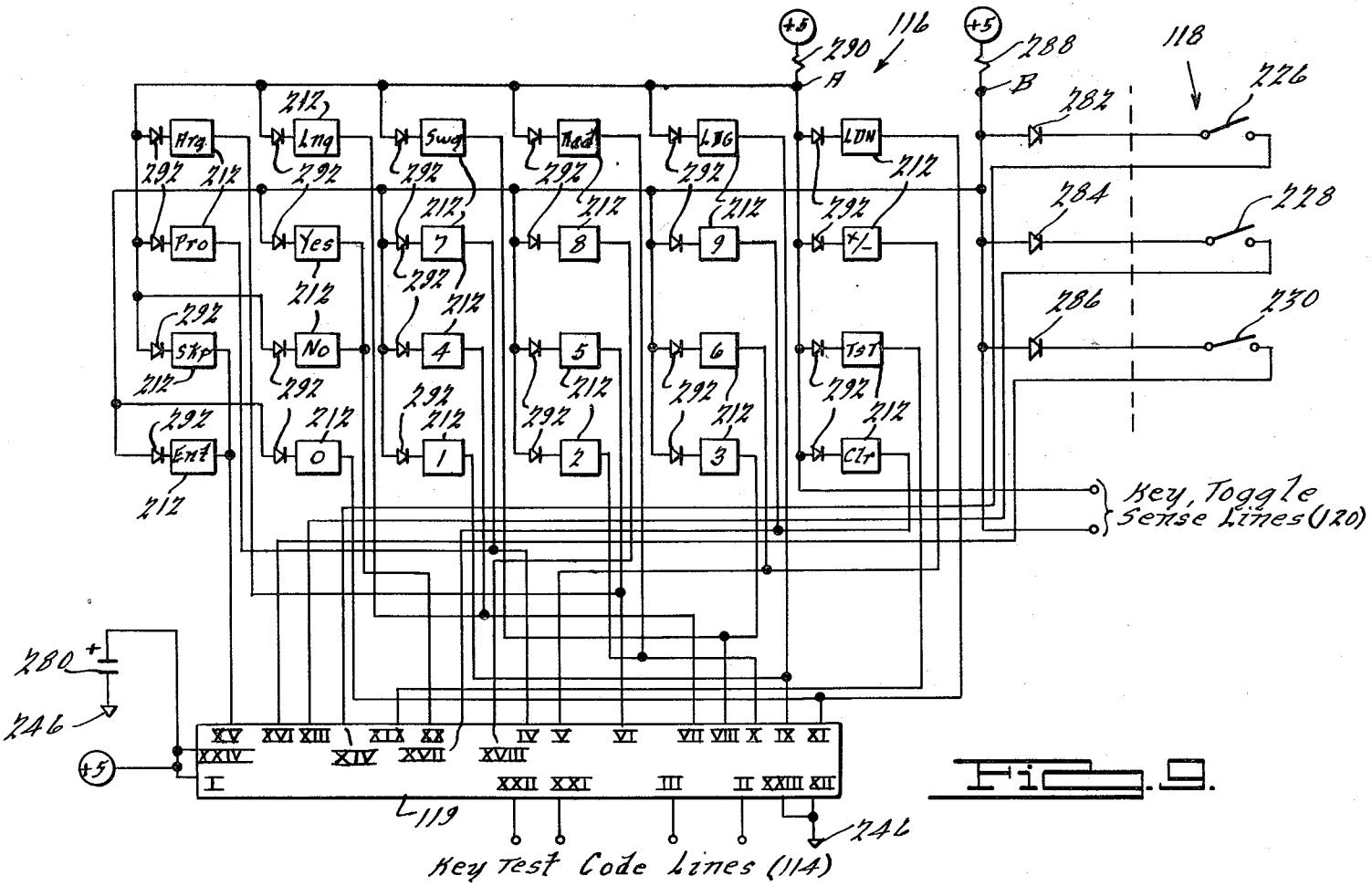
FIG. 9 is a schematic diagram of the set point control and keyboard decoder circuit embodied in the present invention.

Referring to FIG. 9 the schematic diagram of the set point control circuit 118 and the keyboard/decoder circuit 116 is illustrated. Key test code lines 114 from PIA 104 are connected to four to sixteen line decoder 119 input terminals II, III, XXI, XXII. Terminals XXIII and XII of decoder 119 are connected to tie point 246 while terminals XXIV and I are electrically connected directly to the +5 VDC power supply and to the tie point 246 through a 1.0 filter capacitator 280. One side of each toggle switch 226, 228 and 230 are connected to the +5 VDC power supply through separate diodes 282, 284, and 286 respectively and a common current limiting 33 K resistor 288. The other side of toggle switches 226, 228, and 230 are connected to output terminals XIV, XIII, and XVI respectively of four to sixteen line decoder 119. One key, toggle sense line 120 is connected to the +5 VDC power supply through resistor 288. The other key, toggle sense line 120 is connected to the +5 VDC power supply through a second 33 K current limiting resistor 290. For reference, the end of resistor 290 not connected to the +5 VDC power supply is designated as tie point A and the end of resistor 288 which is not associated with the +5 VDC power supply is designated as tie point B.

Output terminals XV of decoder 119 is connected to tie point A through a series combination of "skip" switch 212 and a diode 292 and to tie point B through "enter" switch 212 and another diode 292. Output terminal XIX of decoder 119 is connected to tie point A through a series combination of "test" switch 212 and a diode 292. Output terminal XX of decoder 119 is connected to tie point A through a series combination of "no" switch 212 and a diode 292 and to tie point B through a series combination of "yes" switch 212 and a diode 292. Output terminal XVII of decoder 119 is connected to tie point A through a series combination of "clear" switch 212 and a diode 292 and to tie point B through a series combination of "nine" switch 212 and a diode 292. Output terminal XVIII of decocer 119 is connected to tie point B through a series combination of "eight" switch 212 and a diode 292. Output terminal IV of decoder 119 is connected to tie point A through a series combination of "program" switch 212 and a diode 292 and to tie point B through a series combination of "seven" switch 212 and a diode 292. Output terminal V of decoder 119 is connected to tie point A through a series combination of "+/−" switch 212 and a diode 292 and to tie point B through "six" switch 212 and a diode 292. Output terminal VI of decoder 119 is connected to tie point A through a series combination of "angle" switch 212 and a diode 292 and to tie point B through a series combination of "five" switch 212 and a diode 292. Output terminal VII of decoder 119 is connected to tie point A through a series combination of "length" switch 212 and a diode 292 and to tie point B through a series combination of "four" switch 212 and a diode 292. Output terminal VIII of decoder 119 is connected to tie point A through a series combination of "swing" switch 212 and a diode 292 and to tie point B through a series combination of "three" switch 212 and a diode 292. Output terminal X of decoder 119 is connected to tie point A through a series combination of ƀradius" switch 212 and a diode 292 and to tie point B through a series combination of "two" switch 212 and a diode 292. Output terminal IX of decoder 119 is connected to tie point A through a series combination of "load gross" switch 212 and a diode 292 and to tie point B through a series combination of "one" switch 212 and a diode 292. Output terminal XI of decoder 119 is connected to tie point A through a series combination of "load net" switch 212 and a diode 292 and to tie point B through a series combination of "zero" switch 212 and a diode 292.

The keyboard circuit operates by receiving a test code on lines 114 which sequentially interrogates each switch 212 by grounding one side. Because sense lines 120 are connected to tie points A and B below resistors 290 and 288, crane operator aid 44 can determine if a switch 212 has been actuated by the operator when one of sense lines 120 goes low. The key test code on lines 114 at the precise instance one of sense lines 120 goes low identifies the specific key 112 which has been actuated. Normally, all keys 112 are effectively open circuited and sense lines 120 will both be high. Toggle switches 226, 228, and 230 are interrogated in the same way as are push buttons 212.

Figure 10:
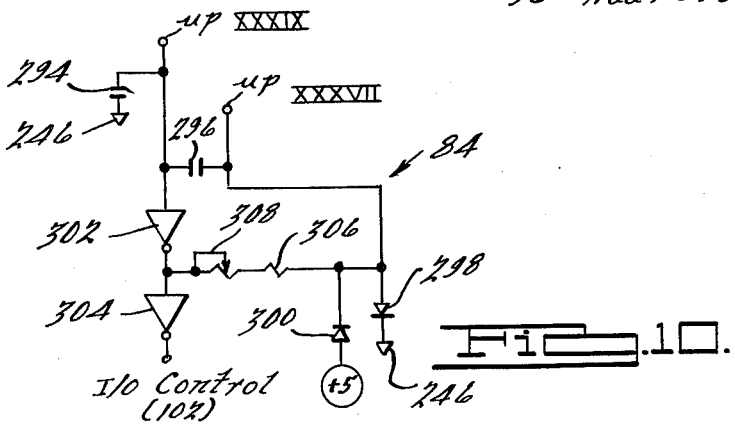
FIG. 10 is a schematic diagram of the clock generator embodied in the present invention.

Referring to FIG. 10, the schematic diagram of clock generator 84 is illustrated. Clock generator 84 interfaces with output terminal XXXIX and input terminal XXXVII of microprocessor 82. Output terminal XXXIX is connected to tie point 246 by a 22 picofarad filter timing capacitor 294 and to input terminal XXVIII is connected to tie point 246 through a forward biased diode 298 and to the +5 VDC power supply through a reverse biased diode 300. Terminal XXXIX is tapped into I/O control bus 102 through a series combustion of two type SN7404 inverters 302 and 304. The point of common connection between inverters 302 and 304 is connected to the cathode side of diode 300 through a series combination of a 2.94 K resistor 306 and a 100 K potentiometer 308. The wiper and one end of potentiometer 308 are commonly tied to the inverters 302 and 304. Part of the oscillator circuit is actually in microprocessor 82 itself, the clock generator 84 comprisin a feedback circuit for the oscillator. Potentiometer 308 and resistor 306 determine the oscillator frequency while diodes 298 and 300 are provided for clipping to improve output wave form shape.

Figures 11, 12, 14:
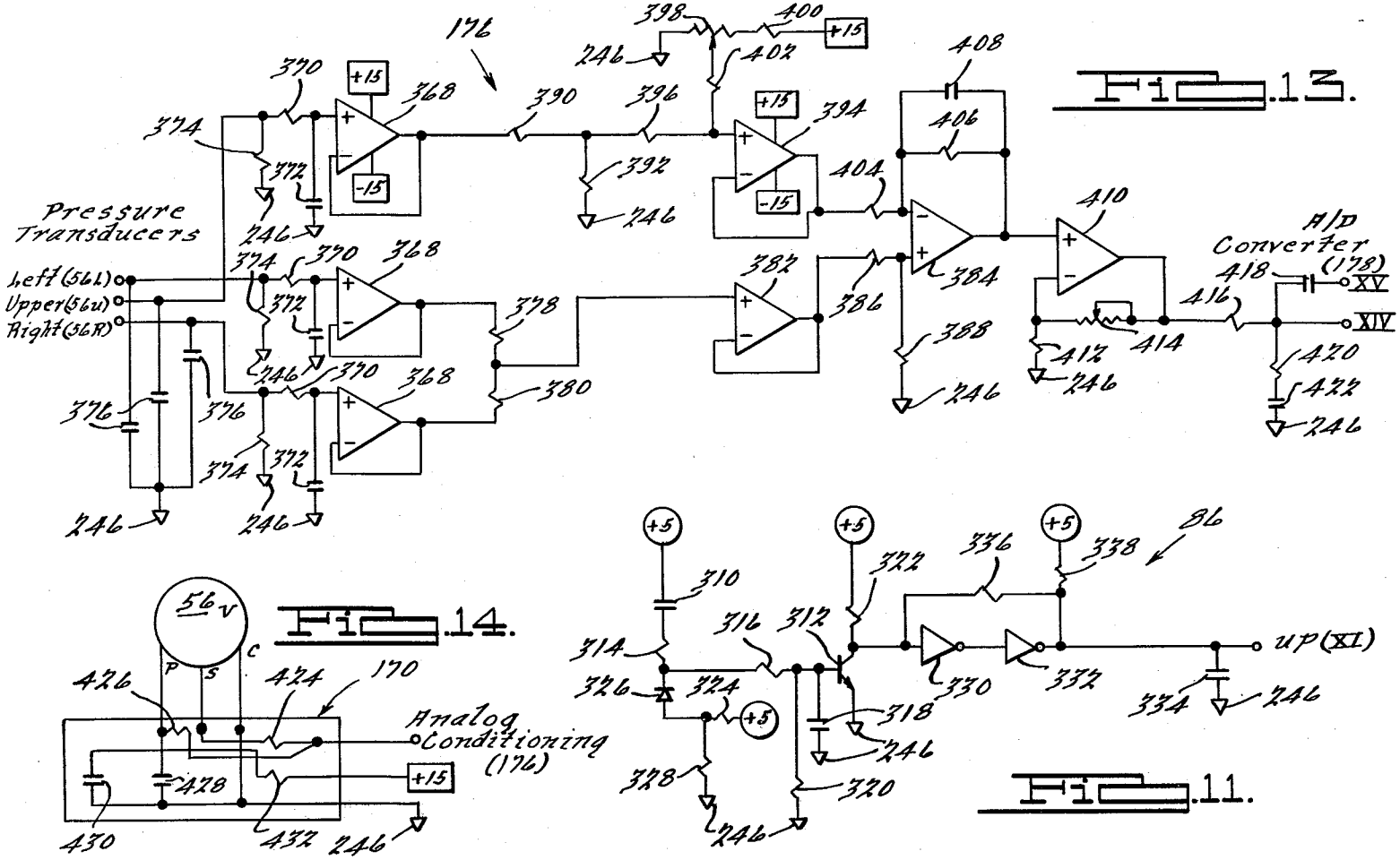
FIG. 11 is a schematic diagram of the power up/reset circuit embodied in the present invention.
FIG. 14 is a schematic diagram, typical of the three pressure transducers and span/zero circuits combined in the present invention.

Referring to FIG. 11, the schematic diagram of power up/reset circuit 86 is illustrated. When on-off/reset switch 234 is thrown +5 VDC is supplied at all of the points indicated. A 10 capacitor 310 receives this voltage step and begins charging, causing a decaying voltage spike. Capacitor 310 is connected to the base of a type 2N5172 transistor 312 through a series combination of a 100 Ohm resistor 314 and 33 K current limiting resistor 316. The base of transistor 312 is connected to tie point 246 through a 0.01 filter capacitor 318 and to tie point 246 through a 33 K drain path resistor 320. The emitter of transistor 312 is connected directly to tie point 246 and the collector is connected to the +5 VDC power supply through a 4.7 K current limiting resistor 322. The point of common connection between resistors 314 and 316 is connected to the +5 VDC power supply through a series combination of a 1 K resistor 324 and a Schottky diode 326. The anode of diode 326 is connected to tie point 246 through a 120 Ohm resistor 328. The collector of transistor 312 is connected to reset input terminal XL of microprocessor 82 through a series combination of two type 7404 inverters 330 and 332. Terminal XL of microprocessor 82 is connected to tie point 246 through a 200 picofarad bypass capacitator 334 and to the collector of transistor 312 through a series 33 K feedback resistor 336. Input terminal XL of microprocessor 82 is also connected to the +5 VDC power supply through a current limiting 1 K resistor 338.

In operation, when the +5 VDC power supply is turned on, capacitor 310 begins to charge causing the base of transistor 312 to see a voltage spike which decays over a relatively short period of time. This causes transistor 312 to momentarily conduct wherein the voltage at the collector varies to produce a reset pulse which is twice inverted in inverters 330 and 332 having hysteresis, resulting in a crisp pulse to low, which resets the microprocessor 82 by initializing the CPU therein. Resistor 324 and Schottky diode 326 biases the base of transistor 312 whereby a "glitch" or temporary drop in supply voltage will cause the CPU to be reinitialized.

Figure 12:
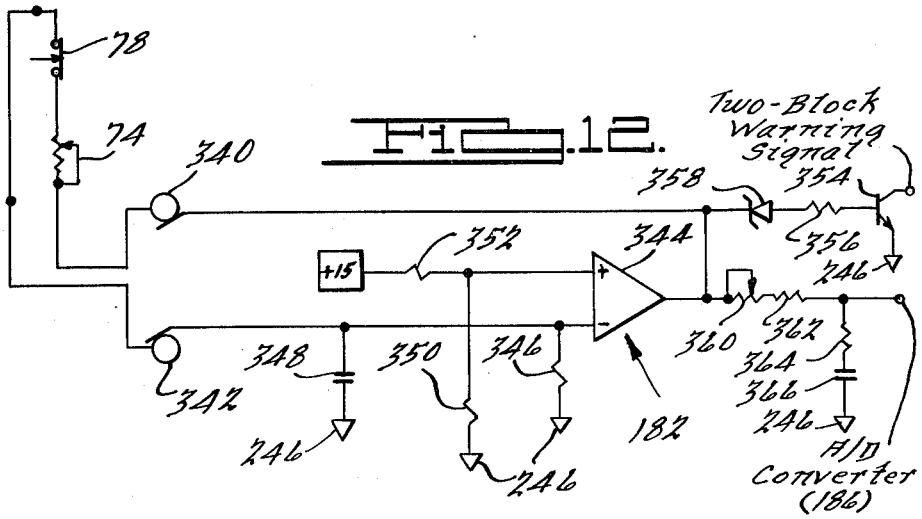
FIG. 12 is a schematic diagram of the optional two-block/jib offset sensor embodied in the present invention.

Referring to FIG. 12, the schematic diagram for the luff angle offset sensor 74, anti two-block switch 78 and analog conditioning circuit 182 is illustrated. Anti two-block switch 78 is mounted on the tip section 28 of boom mechanism 22 or the outwardmost end of fly jib 62 to sense the proximity of hook 42 or 72 to sheeve pulley 38 or 70 respectively. At a predetermined distance from sheeve pulley 38 or 70, hook 42 or 72 opens anti two-block switch 78 to provide a warning signal to the operator or alternatively shutting down the machine. Connected electrically in series with anti two-block switch 78 is luff angle offset sensor 74 comprising a potentiometer having its wiper connected commonly with the side of the fixed resistor opposite switch 778. The wires from switch 78 and sensor 74 are combined in calbe 58 running into combined boom angle/boom length/pressure/conditioner box (transducer housing) 50. Within housing 50 two slip rings 340 and 342 are provided to facilitate deployment of electrical cable to switch 78 and sensor 74 along with cable 58. Slip ring 342 is electrically connected to the negative input of a type LM224 operational amplifier (op amp) 344. The negative input of op amp 344 is also connected to tie point 246 through a 2.94 K reference resistor 346. The negative input of op amp 344 is also connected to tie point 246 through a series 1.0 capacitor 348. The positive input of op amp 344 is connected to tie point 246 through a 2.9 K resistor 350 and to a +5 VDC power supply through a 22.1 K resistor 352. The output to op amp 344 is connected to slip ring 340. The gain of op amp 344 is determined by the feedback resistance or the setting of the potentiometer comprising luff angle offset sensor 74. Resistors 350 and 352 are included to set up a reference voltage. The output of op amp 344 is connected to the base of a type 2N3414 transistor 354 through a series combination of a 820 Ohm current limiting resistor 356 in a reverse biased zenor diode 358. The emitter of transistor 354 is connected directly to tie point 246. The collector of transistor 354 is connected to a two-block warning signal (not illustrated) such as a buzzer or the like or alternatively to an auxilliary relay which shuts down the crane in the event anti two-block switch 78 is opened. In such a case, the feedback path of op amp 344 is opened causing its output to go high, turning on diode 358 and ultimately causing transistor 354 to conduct, triggering the two-block warning signal.

The output of op amp 344 is also connected to A/D converter 186 through a series combination of a 50K potentiometer 360 and a 143K resistor 362. The wiper of potentiometer 360 is connected to the side associated with the output of op amp 344. The input of A/D converter 186 is connected to tie point 246 through a series combination of a 220 Ohm resistor 364 and a 680 picofarad capacitor 366. The resistor 364 and capacitor 366 operate as a filter. Potentiometer 360 serves as a jib luff angle span adjustment into A/D converter 186.

Referring to FIG. 13, the schematic diagram of analog conditioning circuit 176 is illustrated. Analog conditioning circuit 176 has an input from each pressure transducer 56 employed in determining the turning moment about boom pivot point 80. In the preferred embodiment of the invention three such transducers 56 were employed, however, it is contemplated that fewer or more could be used depending upon the specific application. The output signals of the three pressure transducers **56*l*, 56*u*, and 56*r* are fed to the inputs of the analog conditioning circuit 176. Each input is fed into a non-inverting buffer stage comprising a type LN224 op amp 368, the output of which is fed directly back to the negative input, a series 4.75K input resistor 370, a 0.1 capacitor 372 interconnecting the positive input of op amp 368 and tie point 246 and a 3.32K resistor 374 interconnecting the inputs and tie point 246. Each input from transducers 56*l*, 56*u*, and 56*r* is also directly connected to tie point 246 through a 680 picofarad filter capacitor 376. The output of the buffers associated with the left and right pressure transducers 56*l* and 56*r* respectively, are averaged by means of a voltage divider comprising two 22.1K resistors 378 and 380 interconnecting the outputs of op amp 368. The tap of the voltage divider comprising resistors 378 and 380 is connected with the positive input of another buffer type LN224 op amp 382. The output of op amp 382 is connected to its negative input and also to the positive input of a subtractor type LM224 op amp 384 through a 22.1K current limiting resistor 386. The positive input of op amp 384 is connected to tie point 246 through a 22.1K reference resistor 388**.

The output of the non-inverting buffer associated with upper transducer **56*u* is connected to one side of a compensating resistor 390 the other side of which is interconnected to tie point 246 with a 7.68K resistor 392. Resistors 390 and 392 compensate for the difference in area between the rod end and body end of lift rams 32. Resistor 390 has a value which is equal to 7.68K $(1-x)/x$ where x equals the ratio of the rod end area over the barrel end area. The compensated signal is then fed into a positive input of another buffer type LM224 op amp 394 through a 475K resistor 396. The output of op amp 394 is interconnected with its negative input. An offset trim adjustment feature is provided by a 10K potentiometer 398 connected at one end to tie point 246 and at the other end to the +5 VDC power supply through a 22.1K current limiting resistor 400. The wiper of potentiometer 398 is connected to the positive input of op amp 394 through a 475K resistor 402. The output of op amp 394 is connected to the negative input of subtracting op amp 384 through a 22.1K resistor 404. The output of op amp 384 is connected with the negative input by a parallel combination of a 22.1K resistor 406 and a 0.1 capacitor 408. Op amp 384 thus receives a signal in its positive input proportional to the average of the outputs of the left and right pressure transducers 56*l* and 56*r* respectively, and the negative input of op amp 384 receives a compensated signal proportional to the output of upper pressure transducer 56*u*. The output of op amp 384 is the difference between its inputs which represents the net force applied by boom mechanism 22 along the line of axis of lift rams 32. The output of op amp 384 is connected to the positive input of another type LM224 op amp 410. The negative input of op amp 410 is connected to tie point 246 through a 2.94K resistor 412. The output of op amp 410 is connected to its negative input through a potentiometer 414. The wiper of potentiometer 414 is connected to the negative output of op amp 410. Potentiometer 414 provides a final force span adjustment which is used in calibrating operating aid 44 to a specific crane. The output of op amp 410 is connected to input terminal XIV of A/D converter 178 through a 475K resistor 416. Terminal XV and XIV are interconnected by a 680 picofarad capacitor 418. Terminal XIV of A/D converter 178 is connected to tie point 246 through a series combination of 220 Ohm resistor 420 and a 680 picofarad capacitor 422. Resistor 420 and capacitor 422 form an input filter for A/D converter 178**.

For the purposes of this specification terminal designations which appear as Roman Numerals are intended to be applicable only to the specific type of integrated circuit specified as being included in the preferred embodiment of the invention. However, it is contemplated that many other equivalent devices are available and could be substituted for those specified herein by one skilled in the art.

Referring to FIG. 14 a schematic diagram of a pressure transducer 56 and a span/zero circuit 170 typical of the three employed in the preferred embodiment invention is illustrated. Pressure transducer **56*u* is a variable voltage device having three terminals P, S, and C. Terminal P is for power input into transducer 56*u*, terminal C is a ground or common connection with the rest of the system and terminal S is the signal or output of transducer 56*u*. Terminal C is connected directly to common tie point 246. Terminal S is connected to input of analog conditioning circuit 176 through a span calibration resistor 424. The actual value of resistors 424 and 426 are selected to result in an output voltage of 2.40 volts at zero pounds per square inch (psi) pressure in lift ram 32 and 7.40 volts at 3,000 psi. Terminal P of transducer 56*u* is connected to tie point 246 through a 1.0 capacitor 428. Tie point 246 is connected to the +15 VDC power supply through a series combination of a 680 picofarad capacitor 430 and a 10 Ohm resistor 432. Capacitors 428 and 430 and resistor 432** comprise a power supply RC filter to block radio frequency interference (RFI).

Any number of power supplies well known in the art could be employed to complete the operating aid 44. For example, in the preferred embodiment a 12 or 24 VDC battery and ignition system within crane 10 feeds a switching power supply through a transient protection circuit. The output of switching power supply is a regulated 8 VDC which is used to power the lamps in console 46. The regulated 8 VDC also passes through a series pass regulator having a +5 VDC highly regulated output. The +5 VDC output of the series pass regulator is passed through a DC/DC converter to produce a highly regulated +15 VDC output. Implementation of such a power supply is not elaborated upon inasmuch as the hardware and technology is well known in the art.

It is to be understood that the invention has been described with reference to specific embodiments which provide the features and advantages previously described, and that such specific embodiments are susceptible to modification, as will be apparent to those skilled in the art. Accordingly, the foregoing description is not to be construed in a limiting sense.

What is claimed is:

1. A crane operating aid comprising:

sensor means operative to monitor a plurality of predetermined crane status parameters and to generate a separate output signal as a function of each said status parameter;

operator interface means operative in response to operator initiative to sequentially present a series of prompting crane status requests to an operator and to sequentially receive operator responses thereto; and logic means operative to selectively receive said output signals and operator responses, and to generate a crane condition signal as a function thereof.

2. The crane operating aid of claim 1, wherein said sensor means comprises a crane boom length transducer and a boom luff angle transducer.

3. The crane operating aid of claim 2, wherein said sensor means further comprises a boom reaction force transducer.

4. The crane operating aid of claim 2, wherein said sensor means further comprises level sensing means.

5. The crane operating aid of claim 2, wherein said sensor means further comprises a slewing angle transducer.

6. The crane operating aid of claim 2, wherein said sensor means further comprises anti two-block switch means.

7. The crane operating aid of claim 2, wherein said sensor means further comprises a fly jib offset transducer.

8. The crane operating aid of claim 1, wherein said operator interface means comprises a control console adapted to be disposed adjacent a designated operator position of the crane to facilitate sensory and physical interaction between the operator and aid.

9. The crane operating aid of claim 8, wherein said operator interface means further comprises indicia representing said series of status requests and indicator means operative to selectively designate the specific status request soliciting operator response.

10. The crane operating aid of claim 8, wherein said operator interface means further comprises audible alarm means operative to emit a plurality of substantially differing signals under differing predetermined operating conditions.

11. The crane operating aid of claim 8, wherein said operator interface means further comprises visual alarm means operative to emit a plurality of substantially differing signals under differing predetermined operating conditions.

12. The crane operating aid of claim 8, wherein said operator interface means further comprises means operative to selectively receive and display said sensor output signals.

13. The crane operating aid of claim 12, wherein said means for displaying said sensor output signals comprises means for selectively displaying the units in which said signals are presented such as feet, degrees, pounds, and the like.

14. The crane operating aid of claim 8, wherein said operator interface means further comprises a plurality of operator input means.

15. The crane operating aid of claim 14, wherein a first portion of said operator input means comprises data input means.

16. The crane operating aid of claim 15, wherein a second portion of said operator input means comprises mode display selection means.

17. The crane operating aid of claim 8, wherein said operator interface means further comprises operating mode indicator means.

18. The crane operating aid of claim 8, wherein said operator interface means further comprises crane status indicator means.

19. The crane operating aid of claim 8, wherein said operator interface means further comprises set point input means.

20. The crane operating aid of claim 19, wherein said set point input means is operative to receive minimum value set points and maximum value set points.

21. The crane operating aid of claim 8, wherein said operator interface means further comprises set point display means.

22. The crane operating aid of claim 8, wherein said operator interface means further comprises percentage of rated load indicator means.

23. The crane operating aid of claim 22, wherein said percentage of rated load indicator means includes percentage of rate overload indicator means.

24. The crane operating aid of claim 1, further comprising override means operative to receive said output signals and operator responses and to override drive control of the crane under predetermined operating conditions.

25. A crane operating aid comprising:

sensor means operative to monitor a plurality of predetermined crane status parameters and to generate a separate output signal as a function of each said status parameter;

means operative to receive and store said output signals;

operator interface means operative in response to operator initiative to sequentially present a series of prompting crane status requests to an operator and to sequentially receive operator responses thereto; and logic means operative to selectively receive said stored output signals and said operator responses, and to generate a sensible crane condition signal as a function thereof.

26. The crane operating aid of claim 25, wherein said sensor means comprises a crane boom length transducer and a boom luff angle transducer.

27. The crane operating aid of claim 26, wherein said sensor means further comprises a boom reaction force transducer.

28. The crane operating aid of claim 26, wherein said sensor further comprises level sensing means.

29. The crane operating aid of claim 26, wherein said sensor means further comprises a slewing angle transducer.

30. The crane operating aid of claim 26, wherein said sensor means further comprises anti two-block switch means.

31. The crane operating aid of claim 26, wherein said sensor means further comprises a fly jib offset transducer.

32. The crane operating aid of claim 25, wherein said operator interface means comprises a control console disposed adjacent a designated operator position to facilitate sensory and physical interaction between the operator and the aid.

33. The crane operating aid claim 32, wherein said operator interface means further comprises indicia representing said series of status requests and indicator means operative to selectively designate the specific status request soliciting operator response.

34. The crane operating aid of claim 33, wherein said operator interface means further comprises percentage of rated load indicator means and strip select means operative to selectively enable said rated load indicator means and said status request designation indicator means.

35. The crane operating aid of claim 32, wherein said operator interface means further comprises audible alarm means operative to emit a plurality of substantially differing signals under differing predetermined operating conditions.

36. The crane operating aid of claim 32, wherein said operator interface means further comprises visual alarm means operative to emit a plurality of substantially differing signals under differing predetermined operating conditions.

37. The crane operating aid of claim 32, wherein said operator interface means further comprises means operative to selectively receive and display said sensor output signals.

38. The crane operating aid of claim 37, wherein said means for displaying said sensor output signals comprises means for selectively displaying the units in which said signals are presented such as feet, degrees, pounds, and the like.

39. The crane operating aid of claim 32, wherein said operator interface means further comprises a plurality of operator input means.

40. The crane operating aid of claim 32, wherein a first portion of said operator input means comprises data input means.

41. The crane operating aid of claim 39, wherein a second portion of said operator input means comprises mode display selection means.

42. The crane operating aid of claim 32, wherein said operator interface means further comprises operating mode indicator means.

43. The crane operating aid of claim 32, wherein said operator interface means further comprises crane status indicator means.

44. The crane operating aid of claim 32, wherein said operator interface means further comprises set point input means.

45. The crane operating aid of claim 44, wherein said set point input means is operative to receive minimum value set points and maximum value set points.

46. The crane operating aid of claim 32, wherein said operator interface means further comprises set point display means.

47. The crane operating aid of claim 32, wherein said operator interface means further comprises precentage of rated load indicator means.

48. The crane operating aid of claim 47, wherein said percentage of rated load indicator means includes percentage of rated overload indicator means.

49. The crane operating aid of claim 25, wherein further comprising override means operative to receive said output signals and operator responses and to override drive control of the crane under predetermined operating conditions.

50. The crane operating aid of claim 25, wherein said storage means contains predetermined crane operating parametric information.

51. The crane operating aid of claim 50, wherein said sensible crane condition signal is a function of said crane operating parametric information.

52. The crane operating aid of claim 50, wherein said storage means comprises first and second portions, said portions being separable from one another, said first portion operative to receive and store said output signals; and said second portion operative to store said crane operating parametric information.

53. The crane operating aid of claim 1 or 25 wherein said operator interface means is further operative to require an operator response to each status request before posing the next status request in the series.

54. A method of monitoring the operating conditions of a crane and associated load comprising the steps of:

sensing a plurality of predetermined crane status parameters;

generating a separate output signal for each such status parameter;

prompting a crane operator by sequentially posing a series of crane status requests;

receiving operator responses to said requests; and generating a sensible crane condition signal as a function of said output signals and operator responses.

55. The method of claim 54, further comprising the step of repeating the crane status questions periodically during operation of the crane.

56. The method of claim 54, further comprising the step of overriding driver control of the crane under predetermined operating conditions.

57. The method of claim 54, further comprising the step of generating a plurality of substantially differing sensible signals under differing predetermined operating conditions, said sensible signals being a function of said output signals and operator responses.

58. A crane operating aid comprising:

a plurality of transducers adapted for incorporation within a crane, each said transducer operative to monitor a single predetermined crane status parameter and to generate an output signal as a function thereof;

memory means operative to receive and store said output signals;

a control console adapted for disposition adjacent a designated crane operator position and operative in response to operator intiative to sequentially present a series of prompting crane status requests to an operator and to sequentially receiver operator responses thereto prior to operation of said crane; and logic means operative to selectively receive said stored output signals and said operator responses, and to generate a sensible crane condition signal as a function thereof.

* * * * *